US009669634B2

(12) United States Patent
Ros Cerro et al.

(10) Patent No.: US 9,669,634 B2
(45) **Date of Patent: *Jun. 6, 2017**

(54) PRINT HEAD PRIMING SYSTEMS

(71) Applicant: Hewlett-Packard Development Company, L.P., Houston, TX (US)

(72) Inventors: Francesc Ros Cerro, Barcelona (ES); Macià Solé Pons, Barcelona (ES); David Ramírez Muela, Barcelona (ES); Li Qian, Barcelona (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/864,292

(22) Filed: Sep. 24, 2015

(65) Prior Publication Data

US 2016/0009103 A1 Jan. 14, 2016

Related U.S. Application Data

(63) Continuation of application No. 14/057,932, filed on Oct. 18, 2013, now Pat. No. 9,168,752.

(51) Int. Cl.

| | |
|---|---|
| ***B41J 2/19*** | (2006.01) |
| ***B41J 2/165*** | (2006.01) |
| ***B41J 2/175*** | (2006.01) |
| ***B41J 2/17*** | (2006.01) |

(52) U.S. Cl.

CPC ..... *B41J 2/19* (2013.01); *B41J 2/16526* (2013.01); *B41J 2/1707* (2013.01); *B41J 2/17513* (2013.01); *B41J 2/17556* (2013.01); *B41J 2002/17516* (2013.01)

(58) Field of Classification Search

None

See application file for complete search history.

(56) References Cited

U.S. PATENT DOCUMENTS

| | | | | |
|---|---|---|---|---|
| 4,494,124 | A * | 1/1985 | Piatt | B41J 2/1707 347/22 |
| 5,341,160 | A | 8/1994 | Winslow et al. | |
| 5,600,358 | A | 2/1997 | Baldwin et al. | |
| 5,777,647 | A * | 7/1998 | Pawlowski, Jr. | B41J 2/175 347/86 |
| 7,111,917 | B2 | 9/2006 | Hill et al. | |
| 7,887,167 | B2 | 2/2011 | Comas et al. | |
| 8,777,383 | B2 * | 7/2014 | Izawa | B41J 2/16526 137/111 |
| 2002/0024573 | A1 * | 2/2002 | Hoen | B41J 2/17556 347/92 |

(Continued)

OTHER PUBLICATIONS

"Power Jet Plotter Reference Manual", Jan. 17, 2003. <http://www.algotexplotters.com/SUPPORT/Technical/Power%20Jet/Manual/5-A-printheads302.pdf>.

*Primary Examiner* — Justin Seo

(74) *Attorney, Agent, or Firm* — HP Inc—Patent Department

(57) ABSTRACT

A print head priming system comprises a vent closure section to close a vent, where the vent is to compensate backpressure in a print head. An inlet to receive pressurized gas from a source of pressurized gas is to provide the pressurized gas to the print head. A pressure relief valve is to open in response to pressure in the print head reaching or exceeding a predetermined value by the provision of gas to the print head by the source of pressurized gas.

11 Claims, 4 Drawing Sheets

(56) References Cited

U.S. PATENT DOCUMENTS

| | | | | |
|---|---|---|---|---|
| 2002/0044182 | A1* | 4/2002 | Hou | B41J 2/17513 347/86 |
| 2005/0110851 | A1* | 5/2005 | Smith | B41J 2/17553 347/87 |
| 2005/0146575 | A1* | 7/2005 | Hill | B41J 2/1752 347/86 |
| 2007/0222828 | A1* | 9/2007 | Stathem | B41J 2/17596 347/85 |
| 2011/0012964 | A1* | 1/2011 | Coffey | B41J 2/175 347/85 |
| 2012/0001968 | A1 | 1/2012 | Inoue et al. | |
| 2012/0050357 | A1 | 3/2012 | Rasmussen | |
| 2013/0335493 | A1* | 12/2013 | Gonzales | B41J 2/17596 347/92 |

* cited by examiner

PRINT HEAD PRIMING SYSTEMS

CLAIM FOR PRIORITY

The present application is a Continuation of commonly assigned and co-pending U.S. patent application Ser. No. 14/057,932, filed Oct. 18, 2013, the disclosure of which is incorporated herein by reference in its entirety.

BACKGROUND

In printing, such as ink jet printing, print head cleaning and maintenance routines may be performed to improve or maintain good nozzle health. One cleaning method is priming. Priming includes a forced extraction of ink from the print head; this may be to remove blockages from the nozzles, for example.

BRIEF DESCRIPTION OF THE DRAWINGS

Examples of the invention are described hereinafter with reference to the accompanying drawings, in which.

DETAILED DESCRIPTION

Figure 1:
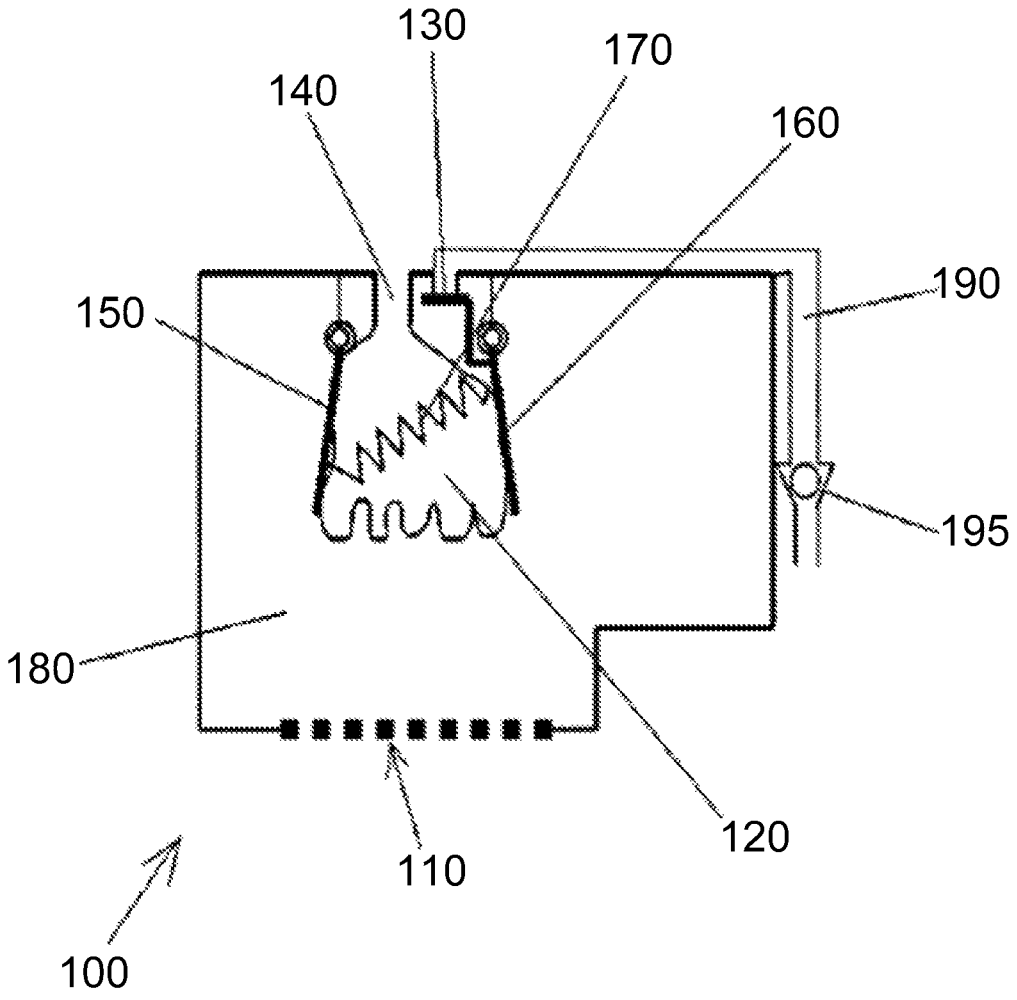
FIG. 1 shows an example of a print head suitable for use with examples of the invention.

FIG. 1 shows an example of a print head 100 suitable for use in some examples of the invention. Print head 100 comprises an ink chamber 180, a plurality of nozzles 110 from which ink drops are fired during printing, and a variable volume air chamber 120 which can expand within the ink chamber 180. The ink chamber has an ink inlet 130 connected to ink conduit 190 in which a check valve 195 may be provided. The variable volume air chamber 120 is connected to the ambient atmospheric pressure through a vent hole 140 with a labyrinth path (not shown), such that the air chamber 120 is maintained at a reference pressure during normal printing. A labyrinth path limits flow of a fluid along its path, for example to limit a rate at which a pressure differential between ends of the path is equalized. The labyrinth path may be external to and separate from the print head 100. The air chamber 120 is flanked by two levers 150 and 160, such that when it expands it causes pivoting of said levers; lever 160 is arranged such that its pivoting movement opens and closes ink inlet 130. A spring 170 is arranged asymmetrically between the two levers urging them against the air chamber 120; due to the asymmetry of the spring, the first part of the expansion of the air chamber 120 only causes pivoting of lever 150, while lever 160 starts pivoting and opens the ink inlet 130 only when the air chamber 120 reaches a certain volume.

During normal printing, ink is forced out of the nozzles 110. The ink may be forced out of individual nozzles 110 by the action of print head firing elements, such as heating elements (not shown). In the absence of vent hole 140, the pressure in the ink chamber 180 would be reduced as ink is forced out of the ink head 100. The resulting back pressure could prevent proper ejection of ink from the print head 100. Accordingly, the vent hole 140 may permit equalization of pressure in the ink chamber 180 with atmospheric pressure, preventing back pressure from inhibiting ejection of the ink from the print head. The vent hole 140 allows equalization of the pressures inside and outside the print head 100, in particular equalization of the pressure in the ink chamber 180 with ambient pressure. This reduces or eliminates the effect of ambient pressure variations on the operation of the print head 100, e.g. due to the height above sea level at which the print head 100 is to be operated.

During a priming event, ink is forced out of the nozzles by increasing the pressure in the ink chamber 180. In some examples, the print head firing elements, which are used to force ink out of the print head 100 during normal printing, are not used during the priming operation.

Modern inks, such as recently developed latex inks, are making serving more difficult. The percentage of solids has increased in some newly developed inks, for example with the addition of components that enhance ink durability. Modern inks may include components such as pigments, latex particles, and wax. These components have limited stability in the vehicle (i.e. the carrier liquid forming the base of the ink, e.g. water). For example, latex and pigment tend to settle, while was tends to float (wax creaming). These effects may make print heads difficult to initialize. In this context, initialize refers to a process of preparing nozzles for printing (e.g. after installation). For example, in some cases the print head becomes clogged during transport and/or storage, and a cleaning process is necessary to enable printing with the proper image quality.

Settling of components and/or wax creaming is dependent on time and temperature (e.g. duration of storage of an ink cartridge and temperature at which an ink cartridge is stored) and may be important at the end of the shelf life of the print head.

The wax may form hard plugs in the nozzles 110, and this can be difficult or impossible to clear with existing priming technology.

When the dies of print heads are exposed to air for a certain period of time (e.g. seconds in some cases), water evaporation from the nozzles 110 may lead to an increase in the viscosity of the ink in the nozzles 110, making nozzle recovery difficult. Recovery procedures, such as spitting or wiping are not efficient in recovering nozzles in these circumstances.

The present inventors have found that the priming process can be improved by increasing the initial rate of increase of pressure in the ink chamber 180. Where the pressure increase is gradual, the flow of ink through clear nozzles 110 reduces the pressure applied to blockages in blocked nozzles 110. In some cases this may result in the priming event failing to clear the blocked nozzles 110. Even in cases where the pressure is sufficient to clear the blocked nozzles 110, additional time is required to reach the required pressure, and ink flow through clear nozzles 110 during this time leads to wasted ink.

Figure 2:
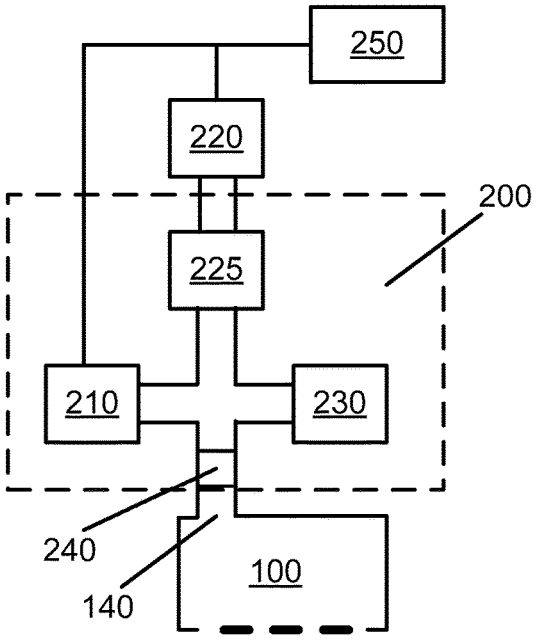
FIG. 2 shows an example of a print head priming system.

FIG. 2 shows an example of a print head priming system 200 including a vent closure section 210, an inlet 225, and a pressure relief valve 230. The inlet 225 is to be connected to a pump 220, to receive pressurized gas from the pump 220. In use (e.g. during priming), each of the vent closure section 210, inlet 225, pump 220, and pressure relief valve 230 are in fluid communication with the vent hole 140 of a print head 100. In the example of FIG. 2, this is via connection section 240. In the example of FIG. 2, a control section 250 is also provided. The control section may commonly control the vent closure section 210 and the pump 220.

The vent closure section 210 is arranged to permit fluid communication between the vent hole 140 of the print head 100 during normal printing. This allows compensation of backpressure and/or equalization of pressure in the print head 100 with ambient pressure via vent hole 140.

During a priming event, the vent closure section 210 prevents communication between the print head 100 (specifically the variable volume air chamber 120) and the ambient pressure. For example, the vent closure section 210 may be a normally open solenoid valve. That is, a valve that is open in the absence of an electrical signal, and closed when an electrical signal (power) is provided to it.

During normal printing, pump 220 does not operate, or at least does not supply pressurized gas to inlet 225, or to vent hole 140. However, during a priming event, pump 220 operates to provide pressurized gas to the air chamber 120 in order to perform the priming operation. The supply of pressurized gas inflates the variable volume air chamber 120 causing ink to be forced out of the ink chamber 180. In addition, inflation of the air chamber 120 moves lever 160, opening the ink inlet and permitting more ink into the ink chamber. In some examples this process causes the ink to drool from the nozzles 110 of the print head 100.

The present inventors found that arranging the vent closure section 210, such that the vent closure section 210 is closed before or simultaneously with the operation of the pump 220 allows a more rapid increase in pressure than is achieved without closing the vent closure section 210. Accordingly, this leads to improved efficiency of priming operations.

Figure 3:
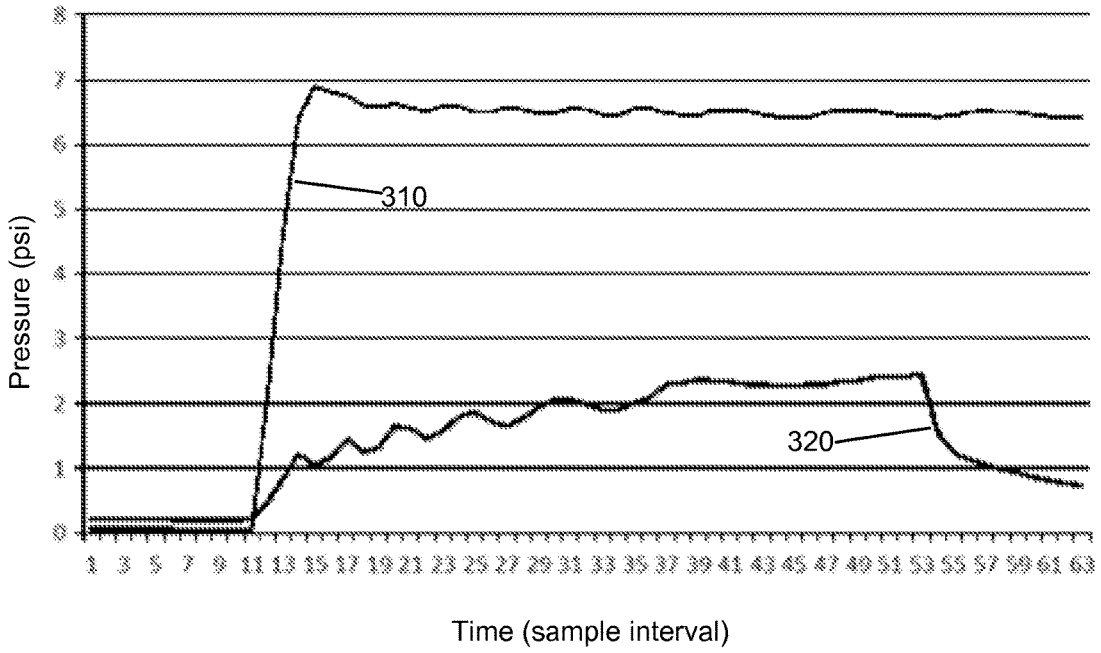
FIG. 3 shows pressure evolution with time during a priming event for a known priming system and an example priming system having the arrangement shown in FIG. 2.

Line 310 of FIG. 3 shows pressure evolution against time of an example arrangement as shown in FIG. 2. In contrast, line 320 corresponds to a known priming device. The vertical axis shows pressure in pounds per square inch (psi) and the horizontal axis shows time in units of sample intervals. In this case, there were four intervals per second, so each interval corresponds to ¼ seconds. As can be seen, it takes around 0.75 seconds (between time samples 11 and 14) for the known priming system to reach a pressure of 1 psi, and around 6.5 seconds to reach a pressure of around 2.25 psi (between time samples 11 and 37). In some applications, such as those using some modern inks, a pressure of 2 psi or more may be required to clear blocked nozzles. The known priming system takes 4.5 seconds or more to reach these pressures, during which time, ink is wasted. In addition, extended priming times may encourage dumping of settled ink components (such as pigment and/or latex) into the nozzles. The known priming device has a maximum pressure of around 2.5 psi, which may be insufficient to clear blocked nozzles in some applications.

As can be seen with respect to line 310, the pressure rapidly increases to a value of approximately 7 psi in around 0.5 seconds. In addition, the peak pressure attained by the example arrangement can be seen to be considerably higher than the pressure obtainable by the known priming system. Thus, examples of the arrangement of FIG. 2 may improve the efficiency and success rate of a priming operation, producing improved results with less ink wastage.

According to some examples, the control section 250 may commonly control the pump 220 and vent closure section 210, such that a single control signal operates both elements. For example, the control section 250 may include a switch that provides power to the pump 220 and vent closure section 210 when the switch is closed, and provides power to neither the pump 220 nor the vent closure section 210 when the switch is open. Thus, the pump 220 and vent closure section 210 are powered on and off simultaneously by the switch. Such an arrangement does not require separate control of the pump 220 and vent closure section 210. This simplifies operation of the priming system, and may simplify retrofitting the priming system to a printing device, such as a printing device having a pump but no vent closure section. Furthermore, common control of the pump 220 and vent closure section 210 may reduce or eliminate a risk of unsynchronized operation of the pump 220 and the vent closure section 210.

The pump 220 and vent closure section may be commonly controlled such that the pump 220 provides gas to the print head 100 in response to a first control stimulus and terminates provision of pressurized gas to the print head 100 in response to a second control stimulus, and the vent closure section 210 is to close in response to the first control stimulus and open in response to the second control stimulus. The first control stimulus may be provision of power to a common power line, to which the pump 220 and vent closure section 210 are both connected. The second control stimulus may be removal of power from the common power line.

According to some arrangements, the vent closure 210 section is closed only while the pump 220 provides pressurized gas to the print head 100 (more specifically, to the air chamber 120 of the print head 100). Further, the vent closure 210 section may be open only while the pump 220 does not provide pressurized gas to the print head 100 (more specifically, to the air chamber 120 of the print head 100).

In some examples, the priming process may increase pressure in the air chamber 120 sufficiently to cause damage to the print head 100, for example by damaging a membrane that forms part of the air chamber 120 wall.

This may be prevented by providing a pressure sensor to monitor a pressure in the print head or priming system, and to open the vent closure section when it is determined that the pressure has reached or exceeded a predetermined value. However, such an arrangement requires additional components, such as the pressure sensor and circuitry to control the vent closure section based on the output of the pressure sensor.

Some examples provide pressure relief valve 230. Pressure relief valve is arranged to open in response to pressure in the print head 100 (e.g. in air chamber 120) reaching or exceeding a predetermined value as a result of the pump 220 providing pressurized air to the print head 100 (air chamber 120).

The pressure relief valve 230 may be a passive component, such as a spring-ball valve, in which a spring biases a ball against or in an opening, thereby closing the opening. When a force due to fluid pressure applied to the ball against the biasing of the spring (i.e. through the opening) exceeds the force of the spring, the ball is forced away from the opening by the fluid pressure and the valve opens. Other passive valves could alternatively be used. Where a passive relief valve is used, no additional control or sensor circuitry is required, permitting a simple construction.

In FIG. 3, the example device (corresponding to line 310) was provided with a pressure relief valve 230 arranged to open at a pressure of approximately 6.5 psi. The pressure relief valve 230 opened around time increment 15, resulting in a peak pressure of almost 7 psi. After the pressure relief valve 230 opened, the pressure drops to around 6.5 psi and remains relatively stable around that pressure. The priming process may be terminated shortly after the peak pressure has been achieved, and would not necessarily be continued for the duration shown in FIG. 3.

According to some examples, the print head 100 communicates with atmospheric pressure only via the nozzles 110 during a first stage of the priming process, between activation of the pump 220 (when the pump 220 begins providing gas under pressure to the print head 100) and opening of the pressure relief valve 230. In a second stage of the priming process, during the period in which the pressure relief valve 230 is open, the print head communicates with the ambient pressure only via the nozzles 110 of the print head 100 and the pressure relief valve 130.

In some examples, during the priming process the air chamber 120 of the print head 100 communicates with ambient pressure only via the pressure relief valve 230. In this case, the air chamber 120 does not communicate with ambient pressure during the priming process when the pressure relief valve is closed 230.

Where the air chamber 120 does not communicate with ambient pressure during a priming process (for example, in contrast to the air chamber 120 communicating with ambient pressure via an always open pressure regulating orifice), a rapid pressure increase can be achieved (or can be more easily achieved).

In some examples the priming process begins when the pump 220 begins providing pressurized gas to the print head 100 (to the air chamber 120), and ends when the pump 220 ceases providing pressurized gas to the print head 100 (air chamber 120).

In some examples an extended priming process may include a series of priming processes in succession, such that the pump 220 is activated and deactivated a predetermined number of times with a predetermined timing. Each priming process may include a brief pressure spike, avoiding priming events of continuous duration (e.g. with a lengthy high pressure plateau) in order to reduce ink wastage. The number of priming processes and timings (e.g. durations, inter-prime timings, frequency, etc.) may be selected based on one or more of print head properties, printer model, ink type, etc. as particular priming patterns may provide improved results in particular applications.

The priming system may be carried on, or move with the print head. In some examples the pump 220 of the priming system 200 is in fluid communication with the air chamber 120 of the print head 100 during normal printing, but pressurized gas is not provided to the air chamber 120 by the pump 220 during normal printing. In such an arrangement, it is not necessary to provide mechanical connection and disconnection of the priming system 200 (or elements of the priming system) between printing and priming operations. This may allow the use of simplified mechanical structures and or control systems. In some examples having multiple print heads, each print head may be provided with a corresponding dedicated priming system. In some examples multiple print heads may be primed by a shared priming system. According to some examples, all print heads sharing a common priming system are primed simultaneously, in other examples the print heads sharing a common priming system are primed sequentially, individually, or in groups. In some examples one or more valves may control fluid connection of the priming system with the print heads.

In some examples the print head may include a single chamber or multiple chambers. In such examples, the priming system may be associated with a single chamber (e.g. one priming system for each chamber) or may be associated with multiple chambers (e.g. one priming system associated with multiple chambers, such that all chambers associated with a particular priming system are primed simultaneously.

Figure 4:
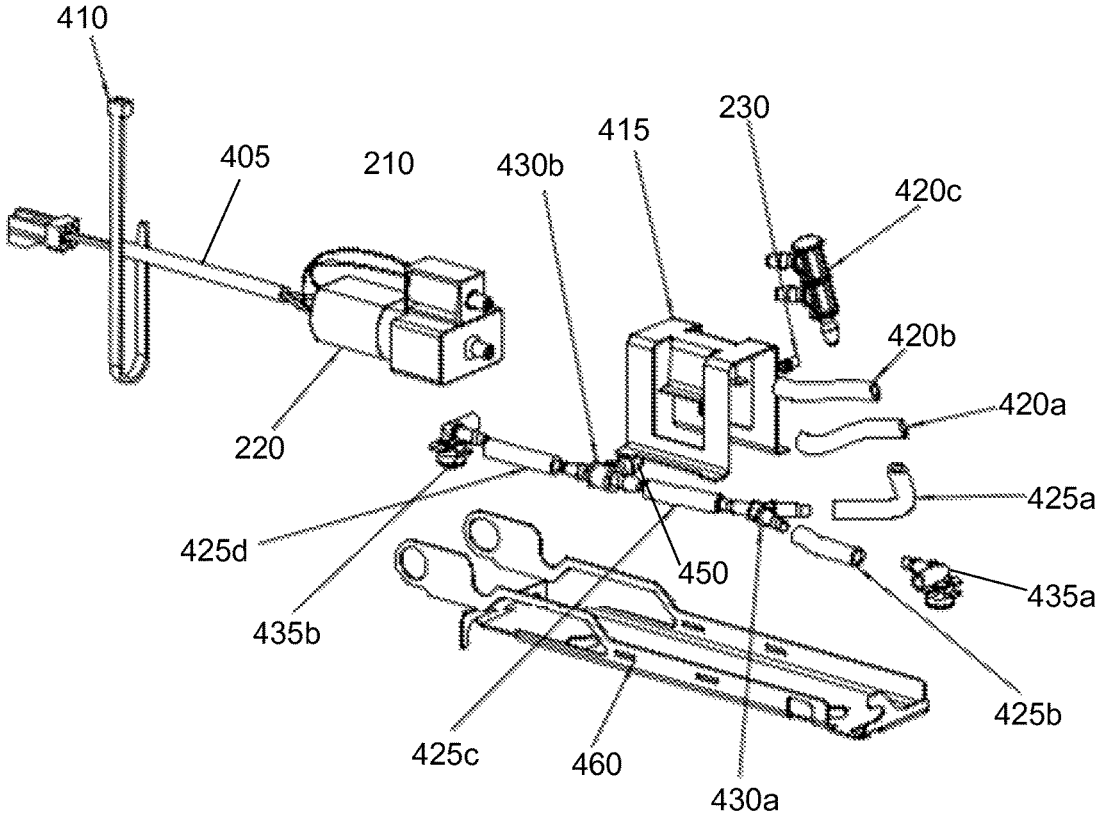
FIG. 4 shows a detailed example of a print head priming system.

FIG. 4 shows an example of a priming system. In this example, pump 220 and vent closure section 210 receive power from a control section 250 via wiring 405. Cable tie 410 may be provided to control and maintain the positioning of wiring 405. The pump 220 and vent closure section 210 are held by holder 415. Tubing elements 420*a* and 420*b* respectively connect the pump 220 and vent closure section 210 with connector 420*c*, such that the pump 220 and vent closure section 210 are in fluid communication. Tubing elements 425*a*, 425*b*, 425*c*, 425*d* and connectors 430*a* and 430*b* connect connector 420*c* with print head connection ports 435*a* and 435*b*, such that print head connection ports 435*a* and 435*b* are in fluid communication with pump 220 and vent closure section 210. This example is suitable for use with a print head having two chambers (for different inks, for example), and so has two print head connection ports 235*a*, 235*b*: one connection port for each chamber of the print head.

Pressure relief valve 230 is provided in a branch 450 of connector 430*b*, such that the pressure relief valve 450 is in fluid communication with the pump 220, vent closure section 210 and print head connection ports 435*a*, 435*b*.

The print head connection ports 435*a*, 435*b* are for connection to respective vent holes 140 of the print head 100, to provide fluid communication between respective variable volume air chambers 120 of the print head 100 and the pump 220, vent closure section 210 (or the vent of the vent closure section 210), and the pressure relief valve 230.

The priming system of FIG. 4 is supported or held by a primer holding section 460 that may be mounted with the print head (e.g. on the print head) in order to move with the print head.

Figure 5:
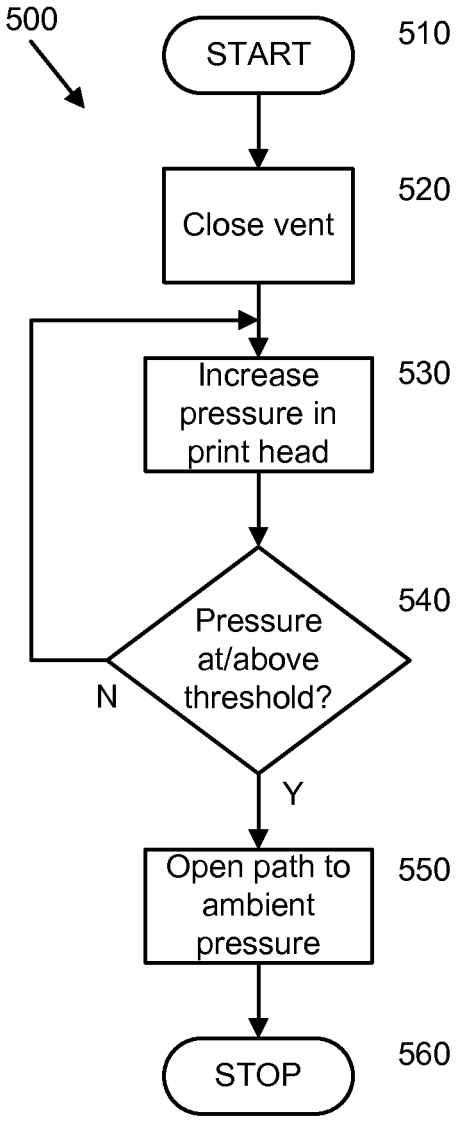
FIG. 5 shows a method of priming a print head.

FIG. 5 illustrates a method 500 according to an example. The method 500 begins at 510, and at 520 a vent 140 for compensating backpressure in a print head 100 is closed. At 530 the pressure in the print head 100 (e.g. in a variable volume air chamber 120) is increased. At 540, if the pressure in the print head has not reached or exceeded a threshold value, the method returns to 530 and the pressure is increased further. If, at 540 the pressure has reached or exceeded the threshold value, the method proceeds to 550 and a path between the print head 100 (e.g. a variable volume air chamber 120) and ambient pressure is opened. The method ends at 560.

In some examples 520 and 530 may be simultaneous, or substantially simultaneous, such that the vent is closed at essentially the same time as the pressure increase begins.

Decision 540 does not necessarily imply that computer logic or other decision making means is utilized. In some examples decision 540 may be implemented by a passive (e.g. mechanical only) valve.

Alternative components could be used in place of a normally open solenoid valve. For example, a piezoelectric valve or a normally closed solenoid valve could be used. A normally closed solenoid valve would require power during a normal printing process. In contrast, a normally open solenoid valve would need to receive power only during a prime, and would not require power during normal printing.

In some examples the pump 220 is a part of the priming system. In other examples, the pump 220 is external to the priming system. In some examples the supply of pressurized gas to the print head 100 may be controlled by turning pump 220 on or off. In some examples, the supply of pressurized air to the print head 100 may be controlled by controlling (e.g. opening or closing) a fluid communication path between pump 220 and inlet 225. In further examples, a fluid path between inlet 225 and vent hole 140 may be controlled (e.g. opened or closed). The fluid path between the pump 220 and vent hole 140 may be controlled using a valve, such as a solenoid valve. The pump 220 may be replaced by any suitable source of pressurized gas. For example, a compressor or pressurized gas tank may be used. In some examples, the source of pressurized gas is dedicated to performing priming (used only for priming the print head), simplifying the structure of the device.

The pressure relief valve may be a purely mechanical relief valve, such that no electronic control system is required for its control. In such examples, no additional electronics, firmware control, electronic pressure sensing, etc. are required for the pressure relief.

The print head may be an ink jet print head. In some examples the print head is a latex print head.

The examples herein have related to ejecting ink from a print head. More generally, the examples may be applied to ejecting printing fluid from a print head. Printing fluid may be, for example, ink, pre-treatment, post-treatment, etc.

In some examples the priming system may be provided with a labyrinth path in the fluid path that includes the vent hole 140 (or the connector of the priming system for connection with vent hole 140) and the vent closure section 210, such that the labyrinth path is between the vent hole 140 and atmospheric pressure during normal printing. The labyrinth path may be provided between the vent hole 140 and vent closure section 210, or may be provided between the vent closure section 210 and atmospheric pressure. Other components may be used in place of a labyrinth path, such as a porous foam element.

Example devices provide a high efficiency design that enables high pressure and steep pressure gradients that provide good recovery efficiency, by improving the performance of the priming process and reducing ink waste and servicing time. Such devices enable long shelf life and better recoverability of print heads, in such as the latest generation of latex print heads.

Devices according to some examples provide good backwards compatibility with existing printers and priming systems. In particular, examples having a passive pressure relief valve and common control of the pump 220 and vent closure section 210 may provide a simple and efficient implementation with good backward compatibility.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers or characteristics described in conjunction with a particular aspect or example of the invention are to be understood to be applicable to any other aspect or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing examples. The invention extends to any novel one, or any novel combination, of the features disclosed in this specification (including any accompanying claims, abstract and drawings), or to any novel one, or any novel combination, of the steps of any method or process so disclosed.

The invention claimed is:

1. A print head priming system comprising:

a vent closure section to close a vent during a priming session of a print head and to open the vent during a printing session to compensate for backpressure in the print head, wherein a control section causes the vent closure section to open and close the vent; and an inlet to receive pressurized gas from a pump to provide the pressurized gas to a vent hole of the print head during the priming session, and terminate the provision of the pressurized gas to the vent hole of the print head during the printing session.

2. The print head priming system of claim 1, further comprising:

a pressure relief valve to be open in response to a determination that a pressure in the print head is greater than a predetermined value during the priming session.

3. The print head priming system of claim 1, wherein the pump and the vent closure section are commonly controlled by the control section, such that:

the pump is to provide the pressurized gas to the vent hole of the print head in response to a first control stimulus and terminate the provision the pressurized gas to the vent hole of the print head in response to a second control stimulus, and the vent closure section is to close the vent in response to the first control stimulus and open the vent in response to the second control stimulus.

4. The print head priming system of claim 1, further comprising:

a switch section to power on and off, simultaneously, the vent closure section and the pump.

5. The print head priming system of claim 1, wherein the print head priming system is to be mounted on the print head.

6. A method for controlling a priming system of a print head, wherein the priming system includes a vent, an inlet, and an outlet to be connected to a vent hole of the print head, the method comprising:

during a priming session of the print head, closing, by a control section, the vent of the priming system and pumping pressurized gas into the inlet of the priming system to provide the pressurized gas to the vent hole of the print head; and during a printing session, opening, by the control section, the vent of the priming system to compensate backpressure in the print head and terminating the pumping of the pressurized gas into the inlet of the priming system.

7. The method of claim 6, wherein the priming system further includes a pressure relief valve, the method further comprising:

determining whether a pressure in the print head is greater than a predetermined value during the priming session; and opening the pressure relief valve during the priming session in response to a determination that the pressure in the print head is greater than the predetermined value.

8. The method of claim 6, further comprising:

activating, by the control section, a pump during the priming session to pump the pressurized gas into the inlet of the priming system; and deactivating, by the control section, the pump during the printing session to terminate pumping the pressurized gas to the inlet of the priming system.

9. The method of claim 8, further comprising:

switching, by a switch section, the vent and the pump on and off simultaneously.

10. A device comprising;

a pump to be activated during a priming session of a print head to provide pressurized gas to a vent hole of the print head and to be deactivated during a printing session; and a vent to be closed during the priming session of the print head, and to be open during the printing session to compensate for backpressure in the print head, wherein a control section causes the vent to open and close.

11. The device of claim 10, further comprising:

a pressure relief valve to be open in response to a determination that a pressure in the print head is greater than a threshold value.

* * * * *